US010665977B2

(12) United States Patent
Freitag et al.

(10) Patent No.: US 10,665,977 B2
(45) Date of Patent: May 26, 2020

(54) JUMP TAB BATTERY TERMINAL CLAMP

(71) Applicant: Royal Die & Stamping, LLC, Carol Stream, IL (US)

(72) Inventors: Erik Freitag, Arlington Heights, IL (US); Nathaniel Jedediah Hollin, Carol Stream, IL (US)

(73) Assignee: Royal Die & Stamping, LLC, Carol Stream, IL (US)

( * ) Notice: Subject to any disclaimer, the term of this patent is extended or adjusted under 35 U.S.C. 154(b) by 0 days.

(21) Appl. No.: 15/725,891

(22) Filed: Oct. 5, 2017

(65) Prior Publication Data

US 2018/0034170 A1 Feb. 1, 2018

Related U.S. Application Data

(63) Continuation of application No. 15/175,326, filed on Jun. 7, 2016, now abandoned.

(51) Int. Cl.

| | |
|---|---|
| ***H01R 13/04*** | (2006.01) |
| ***H01R 11/05*** | (2006.01) |
| ***H01R 11/28*** | (2006.01) |

(52) U.S. Cl.

CPC ..... *H01R 13/04* (2013.01); *H01R 11/05* (2013.01); *H01R 11/287* (2013.01); *H01R 2201/26* (2013.01)

(58) Field of Classification Search

CPC ..... H01R 11/281–289

See application file for complete search history.

(56) References Cited

U.S. PATENT DOCUMENTS

| | | | | | |
|---|---|---|---|---|---|
| 3,585,576 | A | * | 6/1971 | Meyers | H01R 9/16 439/746 |
| 4,054,355 | A | | 10/1977 | Kourimsky et al. | |
| 4,560,229 | A | * | 12/1985 | Benton | H01R 11/289 439/754 |
| 4,560,230 | A | | 12/1985 | Inglis | |
| 4,598,971 | A | * | 7/1986 | Goodman | H01R 11/285 439/726 |
| 4,936,799 | A | | 6/1990 | Woodall | |
| 4,947,115 | A | | 8/1990 | Siemon | |
| 5,183,419 | A | | 2/1993 | Dewar | |
| 5,221,219 | A | | 6/1993 | Thomson | |
| 5,429,531 | A | | 7/1995 | Oster | |
| D371,539 | S | | 7/1996 | O'Glee | |
| 5,588,883 | A | * | 12/1996 | Hattori | H01R 11/282 439/761 |
| 5,688,131 | A | * | 11/1997 | Byfield, Jr. | H01R 4/64 439/883 |

(Continued)

FOREIGN PATENT DOCUMENTS

| | | |
|---|---|---|
| DE | 10226479 | 8/2003 |

*Primary Examiner* — Edwin A. Leon
*Assistant Examiner* — Oscar C Jimenez
(74) *Attorney, Agent, or Firm* — Barnes & Thornburg LLP

(57) ABSTRACT

A battery terminal clamp is provided for a rechargeable storage battery. The battery terminal clamp includes a body portion made of a conductive material. The body portion has a top planar element and a bottom planar element. The top planar element includes an orifice for accommodating the terminal post of a storage battery, and a tab integrally formed with the body portion. This tab extends upwardly from the top planar element, and serves as a secure attachment point for jumper cables.

18 Claims, 4 Drawing Sheets

(56) References Cited

U.S. PATENT DOCUMENTS

| | | | | |
|---|---|---|---|---|
| 5,897,403 | A * | 4/1999 | Kourimsky | H01R 11/283 439/761 |
| 6,551,147 | B2 * | 4/2003 | Wakata | G01R 31/3696 320/105 |
| 6,805,593 | B2 | 10/2004 | Spaulding | |
| 7,001,226 | B2 | 2/2006 | Hermann et al. | |
| 7,374,464 | B1 | 5/2008 | Vicenza et al. | |
| 7,614,921 | B2 * | 11/2009 | Sikora | H01R 11/286 439/726 |
| 9,083,038 | B2 * | 7/2015 | Jones | G01R 31/3637 |
| 2008/0274653 | A1 | 11/2008 | Sikora | |
| 2011/0143595 | A1 * | 6/2011 | Facco | H01R 11/282 439/625 |

* cited by examiner 28
26
20
18
12
30
14
10
38

JUMP TAB BATTERY TERMINAL CLAMP

CROSS-REFERENCE TO RELATED APPLICATIONS

This Application is a continuation of pending U.S. patent application Ser. No. 15/175,326 entitled "Jump Tab Battery Terminal Clamp," filed on Jun. 7, 2016, the disclosure of which is hereby incorporated by reference in their entirety for all purposes.

FEDERALLY SPONSORED RESEARCH OR DEVELOPMENT

Not Applicable.

TECHNICAL FIELD

The invention is directed to a battery terminal clamp of the type used to connect a vehicular battery to the current-consuming components of that vehicle.

BACKGROUND OF THE INVENTION

Electrical current powers various accessories and safety and engine control systems in modern automobiles and other motor vehicles. Electrical power is generally stored in and dispensed to these accessories and systems from a storage battery located under the hood or in the trunk of the vehicle. The electrical current is dispensed to these systems via electrical cables and wires that originate near the positive and negative terminal posts of the storage battery. In most gasoline and hybrid automobiles sold today in the United States, the storage battery is rated at twelve volts.

A battery terminal clamp provides the connection between the cables and the battery terminal posts. Many battery terminal clamp designs are available to vehicle manufacturers. However, these vehicle manufacturers are always seeking improved battery terminal clamp designs.

Because these clamps are typically placed under the hood of the vehicle, they are subjected to road tar, vibration, extreme variations in temperature and ambient humidity, and the deleterious and corrosive effects of rain, snow, and road salt spray.

Battery terminal clamps are typically neither cleaned nor regularly maintained. In fact, they are frequently ignored until the vehicle owner is stranded as a result of the failure of the electrical storage battery or its related cable or wire. As a result, the battery terminal clamps must be rugged and reliable, so as to withstand the harsh conditions to which they are subjected.

Preferably, the design of a battery terminal clamp should be simple, with as few parts and as few moving parts, as possible. The design should be corrosion resistant, easy to fabricate and assemble, and relatively inexpensive to manufacture. The design should also have a relatively low profile, so as to fit within the small under-hood confines of modern lightweight automobiles. The design should be rugged, highly conductive, and provide strong and reliable clamping power.

The typical twelve-volt electrical storage battery that both starts the engine of a motor vehicle, and powers its current drawing components, is rechargeable. During normal operation, that battery is recharged by an on-board alternator or generator that is powered by a system of pulleys and belts secured to the vehicle's engine.

However, during very cold weather or for reasons related to mechanical or electrical failures or malfunctions, the charge of the electrical storage battery may be reduced to an extent that prevents it from adequately cranking and starting the engine. In such a case, one solution is to "jump start" the failing battery with the donor battery from another vehicle. To do this, one end of jumper cables is attached to the failing battery, while another end is attached to the donor battery.

Typically, the ends of the jumper cables are attached to the sides of the battery terminal clamp in both vehicles. The sides of these battery terminal clamps and the jaws of the jumper cables are often of irregular or incompatible shapes or sizes. As a result, the mechanical and electrical connection between the battery terminal clamps and the jaws of the jumper cables is less than ideal.

Accordingly, it is an object of the invention to provide a battery terminal clamp having a charging tab with a regular shape or configuration. It is a further object of the invention to provide a battery terminal clamp having a size and other features that facilitate a secure mechanical and electrical connection to the jaws of a conventional jumper cable.

SUMMARY OF THE INVENTION

The invention is a battery terminal clamp for a rechargeable storage battery. The clamp is used, for example, to connect a rechargeable storage battery of an automobile to the power-consuming parts and accessories of a motor vehicle.

The battery terminal clamp of the invention includes a main body portion. That body portion is typically made of a conductive material, such as copper material, or a brass material, or any other suitable conductive metal or alloy.

The body portion may include a top planar element, and may further include a bottom planar element.

The top planar element includes an orifice for accommodating the terminal post of a storage battery.

A tab is integrally formed with the body portion. Because the tab is integrally formed with the body portion, the thickness of the tab is substantially identical to the thickness of the body portion.

In a preferred embodiment, the tab extends upwardly from the top planar element. The range of angles that the tab may extend upwardly is from 30 to 120 degrees. The most preferred angle that this tab may extend upwardly from the top planar element is 45-60 degrees.

The tab is especially suited for facilitating the attachment of the jaws of jumper cables to the body portion. In this way, the tab permits the jumping of a discharged, rechargeable storage battery. This construction provides an adequate mechanical and electrical connection between the jaws of the jumper cables and the tab.

The battery terminal clamp of the invention may further include an angled portion at the distal end of the tab. This angled portion provides additional aid in securing the jumper cables to the tab during the jumping operation.

In a preferred embodiment of the invention, the lengthwise axis of the tab is generally parallel with the lengthwise axis of the body portion. In this way, the tab does not extend laterally outwardly from the battery terminal clamp.

BRIEF DESCRIPTION OF THE DRAWINGS

To understand the present invention, it will now be described by way of example, with reference to the accompanying drawings in which.

DETAILED DESCRIPTION

Figure 1:
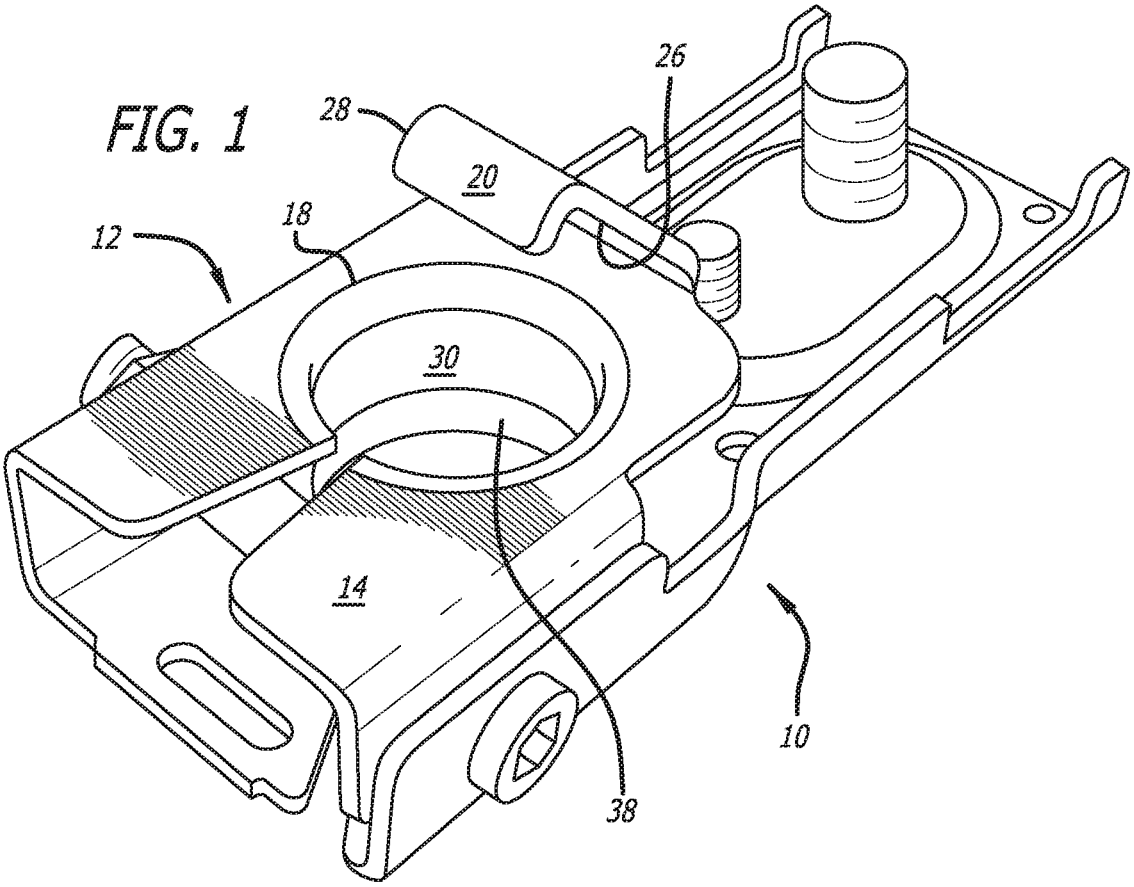
FIG. 1 is a perspective view of one embodiment of the battery terminal clamp of the invention.
Figure 2:
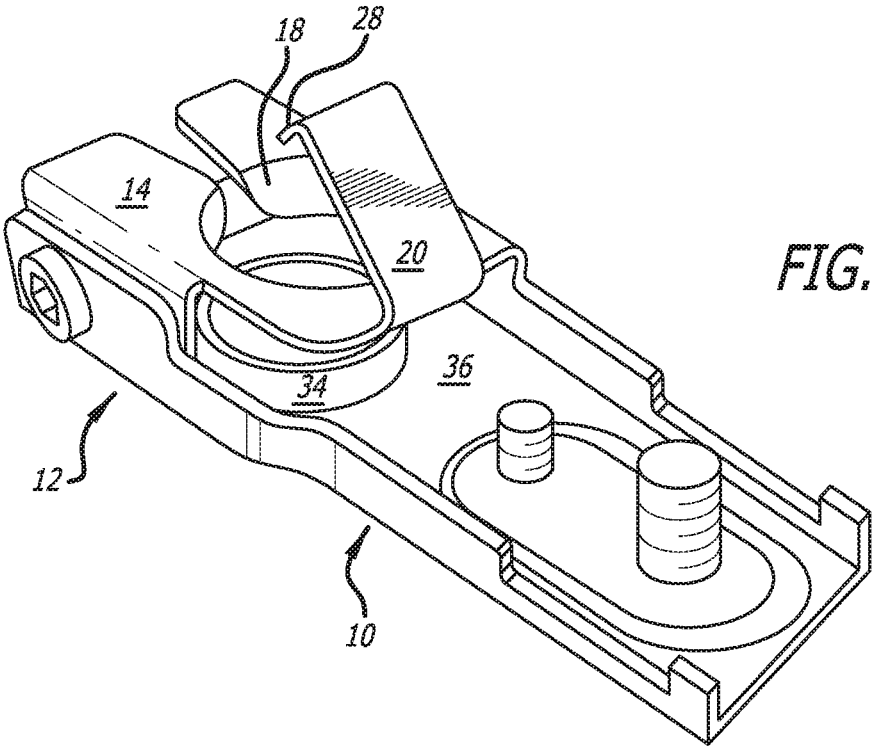
FIG. 2 is a second perspective view of the battery terminal clamp of FIG. 1

Referring now to FIGS. 1 and 2, the invention is a battery terminal clamp 10 for a rechargeable storage battery. The battery terminal clamp 10 is used, for example, to connect a rechargeable storage battery (not shown) of an automobile or other motor vehicle to the accessories, safety and engine control systems, and other power-consuming parts and components of that vehicle. Rechargeable storage batteries used in most contemporary gasoline and hybrid vehicles are rated at approximately twelve volts.

The battery terminal clamp 10 of the invention is made from a rugged, electrically conductive metal, such as a copper material, or a brass material, or any other suitable conductive metal or alloy. In this case, the preferred alloy is a C194 alloy, which is a copper alloy, and specifically a copper-iron-phosphorus alloy.

The battery terminal includes a main body portion 12. In this embodiment, the battery terminal clamp 10 and its body portion 12 are made from a one-piece, stamped element. In the preferred embodiment of the invention, the stamped element is made from C194 alloy having a thickness of approximately 1.63 millimeters. The stamped element is folded and further stamped in the manner necessary to create the battery terminal clamp 10 having the shape depicted in FIGS. 1-6. Preferably, the battery terminal clamp and its body portion 12 are plated with tin, at a plating thickness of at least 0.001 millimeters.

The body portion may include a top planar element 14, and may further include a bottom planar element 16. When battery terminal clamp 10 is mechanically secured to a top-mounted terminal post of a rechargeable storage battery, the top planar element 14 faces upward, and is normally visible to the motorist or mechanic. In contrast, the bottom planar element 16 faces downward, and abuts against and is supported by the outer battery case of the rechargeable storage battery.

Figure 5:
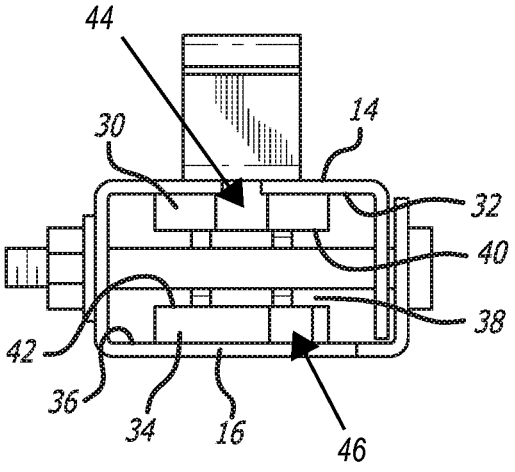
FIG. 5 is a rear view of the battery terminal clamp of FIGS. 1 and 2.

The top 14 and bottom planar elements 16 include an orifice 18 for accommodating the terminal post of the rechargeable storage battery. The portion of this orifice 18 within the top planar element 14 has a diameter of approximately 18.08 millimeters, while the portion of this orifice 18 within the bottom planar element 16 has a diameter of approximately 18.66 millimeters Referring now to FIGS. 1-3 and especially FIG. 5, the top planar element 14 includes a first flange 30 that extends downwardly from the bottom surface 32 of the top planar element 14. The bottom planar element 16 includes a second flange 34 that extends upwardly from the top surface 36 of the bottom planar element 16. There is a gap 38 between the bottom 40 of the first flange 30 and the top 42 of the second flange 34. In this way, the flanges 30 and 34 are separated by this gap 38. Referring to FIG. 5, a first space 44 is disposed along an extent of the first flange 30 and a second space 46 is disposed along an extent of the second flange 34. The first and second spaces 44, 46 are offset from one another as shown in the elevational view of FIG. 5.

As may be seen in each of FIGS. 1-6, a tab 20 is integrally formed with the body portion 12. In this context, integrally formed means that the tab 20 is made of the same stamping as the body portion 12, i.e., that the tab 20 and its body portion 12 are of one piece of metal. Because the tab 20 is integrally formed with the body portion 12, the thickness of the tab 20 is substantially identical to the thickness of the body portion 12, i.e., approximately 1.63 millimeters.

In this preferred embodiment, as may best be seen in FIGS. 1-5, the tab 20 is of a substantially rectangular shape. The tab 20 also extends upwardly from the top planar element 12. This specific orientation of tab 20 has certain advantages. As may be seen in FIG. 6, no portion of the tab 20 extends beyond the entire perimeter of the body portion 12. More specifically, as may also been seen in FIG. 6, no portion of the tab 20 extends outwardly beyond the right side wall 22 and the left side wall 24 of the body portion 12.

Because of these features and the orientation of the tab 20, the motorist or mechanic who seeks to jump start a battery will have easy access to the tab 20. First, the tab 20 is at the top of the battery terminal clamp 10, which is an area that is generally open to view, unobstructed, and easily accessible.

Second, the tab 20 is not outside of the perimeter of the body portion 12 of the battery terminal clamp 10, and specifically the tab 20 is inboard both the right side wall 22 and the left side wall 24 of the body portion 12. As a result, the tab 20 is not in an area closely adjacent to other under-hood components, nor near walls or suspension components that could obstruct access to that tab 20.

Figure 3:
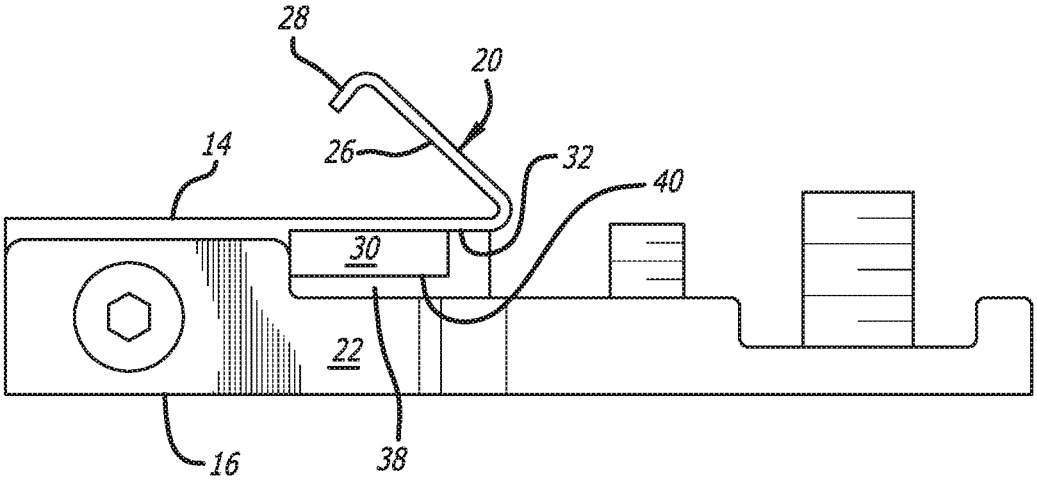
FIG. 3 is a right side view of the battery terminal clamp of FIGS. 1 and 2.
Figure 4:
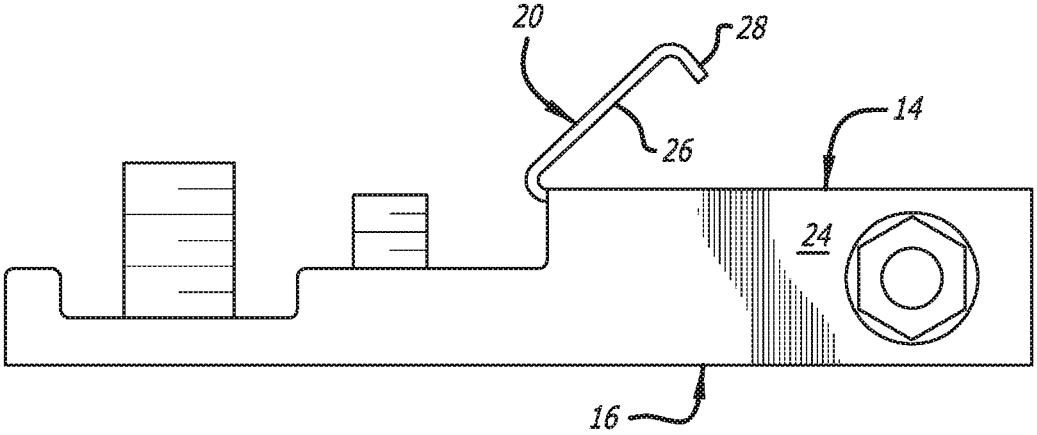
FIG. 4 is a left side view of the battery terminal clamp of FIGS. 1 and 2.

As may best be seen in FIGS. 3 and 4, the tab 20 is positioned at an angle to the top planar element 14. The angle between the tab 20 and the top planar element 14 should be adequate to ensure that the jaws of a jumper cable will be able to be securely fastened to the tab 20, and especially to the underside 26 of the tab 20. The probable range of angles that the tab 20 may extend upwardly is from about an acute angle of 30 degrees to about an obtuse angle of 120 degrees. The most preferred angle that this tab 20 may extend upwardly from the top planar element is forty-five (45) degrees.

For these and other reasons, the tab 20 is especially suited for facilitating the attachment of the jaws of jumper cables to the body portion 12. In this way, the tab 20 enables the easy, quick jumping of a discharged, rechargeable storage battery. This flat, generally rectangular construction provides an adequate, effective mechanical and electrical connection between the jaws of the jumper cables and the tab 20.

As may best be seen in FIGS. 1-4, the battery terminal clamp 10 of the invention may further include an angled portion 28 at the distal end of the tab 20. This angled portion 28 provides additional aid in securing the jumper cables to the tab 20 during the jumping operation, and particularly in aiding in preventing the inadvertent removal of the jumper cables from the tab 20 during that jumping operation.

Figure 6:
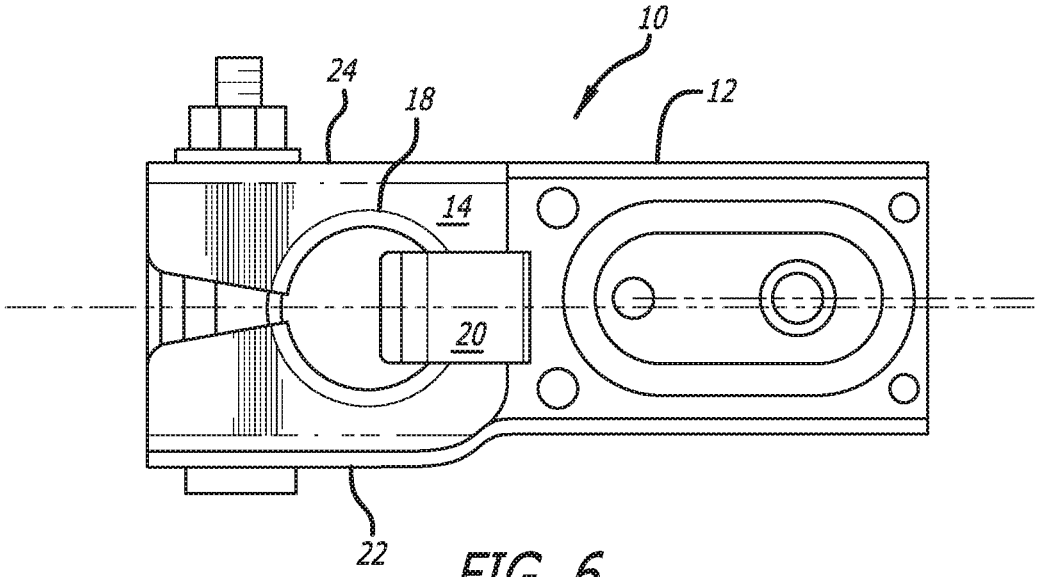
FIG. 6 is an overhead view of the battery terminal clamp of FIGS. 1 and 2.

As may best be understood from the two horizontal, dashed lines of FIG. 6, in a preferred embodiment of the invention the lengthwise axis of the tab 20 is generally parallel with the lengthwise axis of the body portion 12. This common axial orientation of the tab 20 and the body portion 12 is yet another reason why the tab 20 does not extend laterally outwardly from the perimeter of the battery terminal clamp 10.

What is claimed is:

1. A battery terminal clamp for a rechargeable storage battery, the battery terminal clamp comprising:

(a) a body portion made of a conductive material;

(b) the body portion including a top planar element and a bottom planar element;

(c) the top and bottom planar elements including an orifice for accommodating a terminal post of a storage battery;

(d) a first flange extending from the top planar element, and a second flange extending from the bottom planar element, the flanges being separated by a gap;

(e) a tab integrally formed with the body portion, and extending upwardly from the top planar element past an edge of the orifice in the top planar element, the tab arranged to couple the body portion to jumper cables.

2. The battery terminal clamp of claim 1, wherein the tab includes a downwardly angled portion at a distal end of the tab to secure the jumper cables during a jumping operation.

3. The battery terminal clamp of claim 1, the tab having a tab width and a tab length that exceeds said tab width, the body portion having a body width and a body length that exceeds said body width, and wherein a lengthwise axis of the tab is generally parallel with a lengthwise axis of the body portion.

4. The battery terminal clamp of claim 1, wherein a thickness of the tab is substantially identical to a thickness of the body portion.

5. The battery terminal clamp of claim 1, wherein the tab extends upwardly relative to the top planar surface at an angle of approximately 45 degrees.

6. A battery terminal clamp, comprising: (a) a body portion made of a conductive material and including a top planar element and a bottom planar element; (b) a first flange extending downward from the top planar element and having a semi-continuous configuration that includes a first flange space, and a second flange extending upward from the bottom planar element and having a semi-continuous configuration that includes a second flange space, the flanges being separated by a gap and the first and second flange spaces are offset from each other; (c) a tab integrally formed with the body portion, and extending upwardly from the top planar element, the tab configured for attachment of a pair of jumper cables to the body portion, during recharging of a rechargeable storage battery; wherein the top planar element includes a top orifice and the bottom planar element includes a bottom orifice, and wherein the tab extends past an edge of the top orifice.

7. The battery terminal clamp of claim 6, wherein the first and second flange spaces are angularly offset from each other.

8. The battery terminal clamp of claim 7, wherein the top and bottom orifices are aligned to form a passageway that receives an extent of a terminal post of the rechargeable storage battery.

9. The battery terminal clamp of claim 6, wherein the tab includes a base portion adjacent the top planar element, an intermediate portion and an angled portion disposed at a distal end of the tab, and wherein the angled portion overlies the top orifice.

10. The battery terminal clamp of claim 6, wherein the angled portion is angled downward towards the top orifice.

11. The battery terminal clamp of claim 6, wherein the tab extends from an end of the top planar element opposite the first flange space.

12. A battery terminal clamp for a rechargeable battery, the battery terminal clamp comprising:

a body portion made of a conductive material and including:

(a) a top planar element having a downwardly extending top flange that defines a top orifice, the top flange having a semi-continuous configuration that includes a top flange space;

(b) a bottom planar element having an upwardly extending bottom flange that defines a bottom orifice, the bottom flange having a semi-continuous configuration that includes a bottom flange space; and, (c) a tab integrally formed with the body portion and extending upwardly from the top planar element past an edge of the top orifice, the tab configured for attachment of a pair of jumper cables to the body portion during recharging of the rechargeable battery.

13. The battery terminal clamp of claim 12, wherein the top and bottom flange spaces are angularly offset from each other.

14. The battery terminal clamp of claim 12, wherein the top and bottom orifices are aligned to form a passageway that receives an extent of a terminal post of the storage battery.

15. The battery terminal clamp of claim 12, wherein the tab includes a base portion adjacent the top planar element, an intermediate portion and an angled portion disposed at a distal end of the tab, and wherein the angled portion overlies the top orifice.

16. The battery terminal clamp of claim 15, wherein the angled portion is angled downward towards the top orifice.

17. The battery terminal clamp of claim 12, wherein the tab extends from an end of the top planar element opposite the top flange space, and wherein the tab does not extend beyond an outer periphery of the body as defined by the top planar element.

18. The battery terminal clamp of claim 12, the tab having a tab width and a tab length that exceeds said tab width, the body portion having a body width and a body length that exceeds said body width, and wherein a lengthwise axis of the tab is generally aligned with a lengthwise axis of the body portion.

* * * * *